US008869703B1

(12) United States Patent
Miller

(10) Patent No.: US 8,869,703 B1
(45) Date of Patent: Oct. 28, 2014

(54) TECHNIQUES UTILIZING HIGH PERFORMANCE ARMOR PENETRATING ROUND

(71) Applicant: Textron Systems Corporation, Wilimington, MA (US)

(72) Inventor: Clayton W. Miller, Reading, MA (US)

(73) Assignee: Textron Systems Corporation, Wilmington, MA (US)

( * ) Notice: Subject to any disclaimer, the term of this patent is extended or adjusted under 35 U.S.C. 154(b) by 225 days.

(21) Appl. No.: 13/656,241

(22) Filed: Oct. 19, 2012

(51) Int. Cl.
*F42B 12/04* (2006.01)

(52) U.S. Cl.
USPC ..... 102/514; 102/516; 102/518

(58) Field of Classification Search
CPC ..... F42B 12/04; F42B 12/10; F41B 12/06
USPC ..... 102/370, 439, 504, 514, 516–519
See application file for complete search history.

(56) References Cited

U.S. PATENT DOCUMENTS

| | | | | | |
|---|---|---|---|---|---|
| 1,141,783 | A | * | 6/1915 | Dobregeansky | 102/516 |
| 1,380,773 | A | | 6/1921 | Clay | |
| 2,096,698 | A | * | 10/1937 | Lowy et al. | 102/370 |
| 2,465,962 | A | * | 3/1949 | Allen et al. | 89/14.05 |
| 2,724,334 | A | * | 11/1955 | Norton et al. | 102/518 |
| 3,348,485 | A | * | 10/1967 | Dufour | 102/518 |
| 3,370,535 | A | * | 2/1968 | Permutter | 102/518 |
| 3,780,658 | A | * | 12/1973 | de Longueville et al. | 102/518 |
| 3,782,287 | A | * | 1/1974 | Sie | 102/516 |
| 3,795,196 | A | * | 3/1974 | Hillenbrand | 102/518 |
| 3,948,180 | A | | 4/1976 | Silvia et al. | |
| 4,444,112 | A | | 4/1984 | Strandli et al. | |
| 4,612,860 | A | * | 9/1986 | Flatau | 102/518 |
| 5,009,166 | A | * | 4/1991 | Bilsbury et al. | 102/516 |
| 5,069,139 | A | * | 12/1991 | Denis | 102/518 |
| 5,127,332 | A | * | 7/1992 | Corzine et al. | 102/509 |
| 5,175,392 | A | * | 12/1992 | Denis | 102/364 |
| 5,299,501 | A | * | 4/1994 | Anderson | 102/364 |
| 5,567,906 | A | * | 10/1996 | Reese et al. | 102/307 |
| 5,789,698 | A | * | 8/1998 | Beal | 102/516 |
| 5,847,313 | A | | 12/1998 | Beal | |
| 6,085,661 | A | * | 7/2000 | Halverson et al. | 102/516 |
| 6,371,029 | B1 | * | 4/2002 | Beal | 102/516 |
| 6,672,218 | B2 | * | 1/2004 | Oechslin et al. | 102/374 |
| 6,772,695 | B2 | * | 8/2004 | Kellner | 102/516 |
| 6,789,484 | B2 | | 9/2004 | Kellner | |

(Continued)

FOREIGN PATENT DOCUMENTS

| | | |
|---|---|---|
| CH | 654406 A5 | 2/1986 |

*Primary Examiner* — Bret Hayes
*Assistant Examiner* — Joshua Freeman
(74) *Attorney, Agent, or Firm* — BainwoodHuang

(57) ABSTRACT

An armor penetrating round includes an elongated core portion (e.g., a hollow tool steel core) defining a front end, an aft end, and a central cavity which extends from the aft end toward the front end. The central cavity has (i) an aft cross-sectional diameter adjacent the aft end and (ii) a front cross-sectional diameter adjacent the front end, the aft cross-sectional diameter being larger than the front cross-sectional diameter. The armor penetrating round further includes a slug portion (e.g., a pre-compacted pellet of powdered metal) which is disposed within the central cavity adjacent the aft end, and an outer jacket (e.g., a copper jacket) which extends around the elongated core portion to operate as an interface between the armor penetrating round and a gun barrel when the armor penetrating round is fired through the gun barrel.

20 Claims, 5 Drawing Sheets

(56) References Cited

U.S. PATENT DOCUMENTS

| | | | | |
|---|---|---|---|---|
| 7,603,951 | B2 * | 10/2009 | Rose et al. | 102/364 |
| 7,765,934 | B2 * | 8/2010 | Spatz et al. | 102/518 |
| 8,393,273 | B2 * | 3/2013 | Weeks et al. | 102/506 |
| 2002/0152915 | A1 * | 10/2002 | Vaughn et al. | 102/507 |
| 2003/0221580 | A1 * | 12/2003 | Beal | 102/516 |
| 2007/0017409 | A1 | 1/2007 | Mansfield et al. | |
| 2007/0204758 | A1 | 9/2007 | Spatz et al. | |
| 2008/0141889 | A1 * | 6/2008 | Beal | 102/439 |
| 2009/0294176 | A1 * | 12/2009 | Gessel et al. | 175/57 |
| 2013/0327571 | A1 * | 12/2013 | Andrzejak | 175/2 |

* cited by examiner

TECHNIQUES UTILIZING HIGH PERFORMANCE ARMOR PENETRATING ROUND

BACKGROUND

A standard .50 caliber armor piercing bullet includes a copper jacket, a lead nose, and a tool steel core. The tool steel core is disposed behind the lead nose, and the copper jacket extends around the tool steel core to engage rifling of the gun barrel during firing.

When such an armor piercing bullet is fired at a target, the bullet may strike the target with an impact velocity which exceeds 800 meters per second. At such a speed, the bullet is capable of penetrating rolled homogenous armor (RHA) to a depth of approximately 2.9 cm.

SUMMARY

An improved armor penetrating round utilizes a hollow core which contains a slug to achieve penetration effects beyond that of the above-described standard armor piercing bullet. In particular, in the improved armor penetrating round, the slug initially resides at the back of a tapered cavity within the core. When the improved armor penetrating round impacts an armored target such as an armor plate, the material of the slug decouples from the back of the tapered cavity within the core and accelerates through the tapered cavity in the direction of the armor plate. As the material of the slug slides along the tapered walls of the core within the cavity, the slug material forms a jet which provides further penetration into and perhaps through the armor plate. Accordingly, the improved armor penetrating round is capable of providing enhanced destructive and/or lethal effects beyond conventional armor piercing bullets.

One embodiment is directed to an armor penetrating round which includes an elongated core portion (e.g., a hollow tool steel core) defining a front end, an aft end, and a central cavity which extends from the aft end toward the front end. The central cavity has (i) an aft cross-sectional diameter adjacent the aft end and (ii) a front cross-sectional diameter adjacent the front end, the aft cross-sectional diameter being larger than the front cross-sectional diameter. The armor penetrating round further includes a slug portion (e.g., a pre-compacted pellet of powdered metal) which is disposed within the central cavity adjacent the aft end, and an outer jacket (e.g., a copper jacket) which extends around the elongated core portion to operate as an interface between the armor penetrating round and a gun barrel when the armor penetrating round is fired through the gun barrel.

Other embodiments are directed to ammunition and other projectiles which include such armor penetrating rounds. Yet other embodiments are directed to processes of making and using such armor penetrating rounds, and so on.

BRIEF DESCRIPTION OF THE DRAWINGS

The foregoing and other objects, features and advantages will be apparent from the following description of particular embodiments of the present disclosure, as illustrated in the accompanying drawings in which like reference characters refer to the same parts throughout the different views. The drawings are not necessarily to scale, emphasis instead being placed upon illustrating the principles of various embodiments of the present disclosure.

DETAILED DESCRIPTION

An improved armor penetrating round utilizes a hollow metallic core which contains a slug to achieve penetration effects beyond that of conventional armor piercing bullets. In particular, in the improved armor penetrating round, the slug initially resides at the back of a tapered cavity within the core. When the improved armor penetrating round impacts an armored target such as a rolled homogenous armor (RHA) plate, the material of the slug (e.g., powdered metal) decouples from the back of the tapered cavity and accelerates through the tapered cavity in the direction of the target. As the slug material slides along the tapered core walls, the slug material accelerates and forms a jet which provides further penetration into and perhaps through the plate. Accordingly, the improved armor penetrating round is capable of providing enhanced destructive and/or lethal effects beyond conventional armor piercing bullets (e.g., a standard .50 caliber armor piercing bullet).

Figure 1:
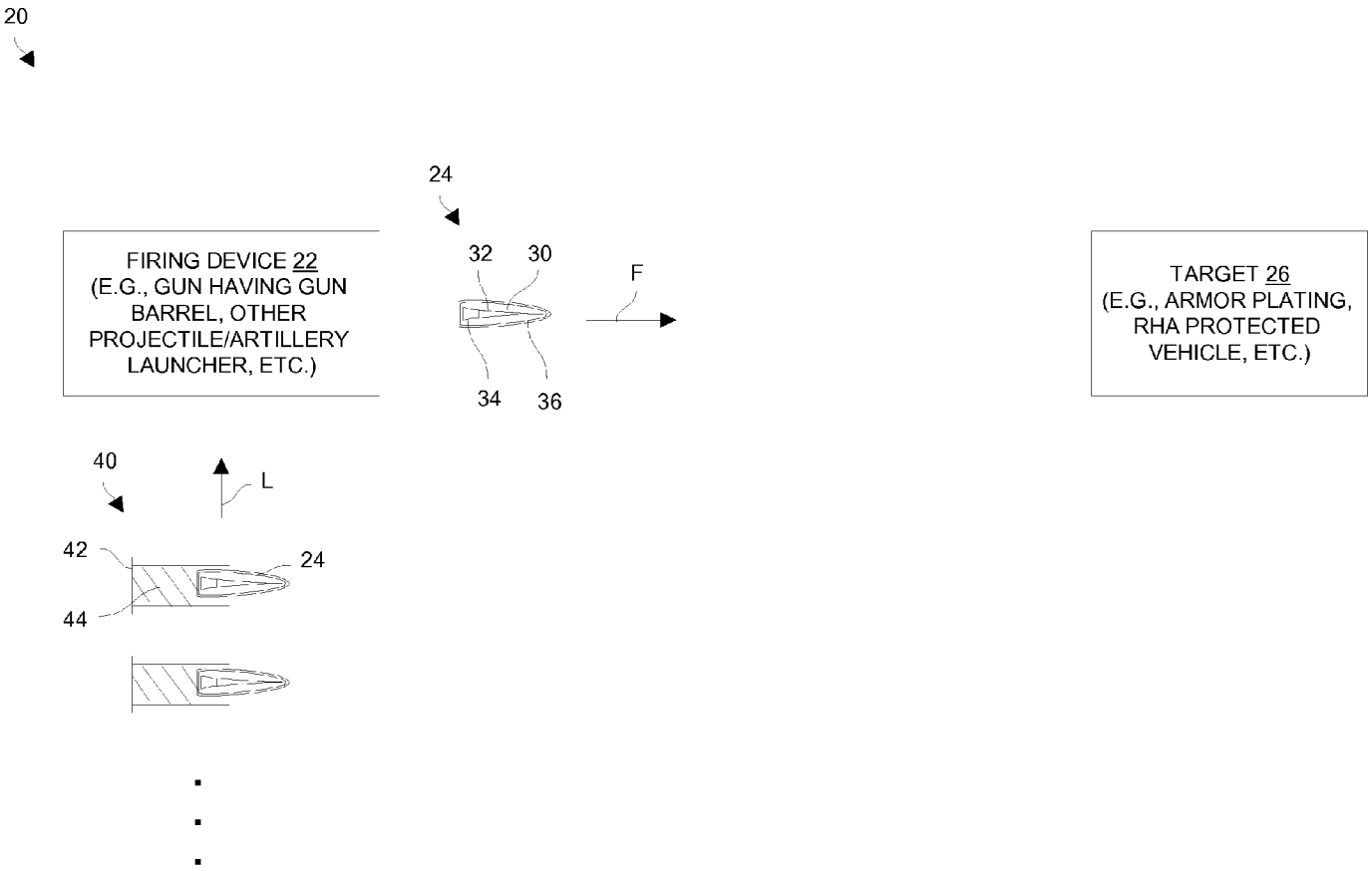
FIG. 1 is a general diagram illustrating particular details of high performance armor penetrating rounds.

FIG. 1 shows a situation 20 in which a firing device 22 fires a high performance armor penetrating round 24 at a target 26. Various apparatus are suitable for use as the firing device 22 such as a gun, a cannon, or similar type of projectile launcher.

Each high performance armor penetrating round 24 includes an elongated core 30 which defines a cavity 32 which narrows (or tapers) from back to front, a slug 34 which is disposed within the cavity 32, and an outer jacket 36. As will be explained in further detail shortly, when such a round 24 is fired from the firing device 22 in a forward direction F (see arrow F in FIG. 1) and impacts the target 26, the material of the slug 34 accelerates through the cavity 32 in the forward direction F to causing further destructive effects.

As shown by the arrow L in FIG. 1, the armor penetrating rounds 24 are loaded into the firing device 22 in the form of ammunition 40. Each round of ammunition 40 may be loaded individually or manually, e.g., hand loaded by a user. Alternatively, the firing device 22 may receive rounds of ammunition 40 automatically a faster rate and in a less burdensome manner than that of hand loading, e.g., from an ammunition belt or a magazine, etc.

Each round of ammunition 40 includes a shell 42, propellant 44 which is loaded within the shell 42, and an armor penetrating round 24. When a round of ammunition 40 is loaded within the firing device 22 and fired, the propellant 44 within that ammunition round 40 ignites and propels the armor penetrating round 24 from the shell 42 and through the barrel of the firing device 22 toward the target 26. As will now be explained in further detail with reference to FIGS. 2-4, the armor penetrating round 24 is constructed and arranged to provide enhanced destructive and lethal effects upon impact with the target 26.

Figure 2:
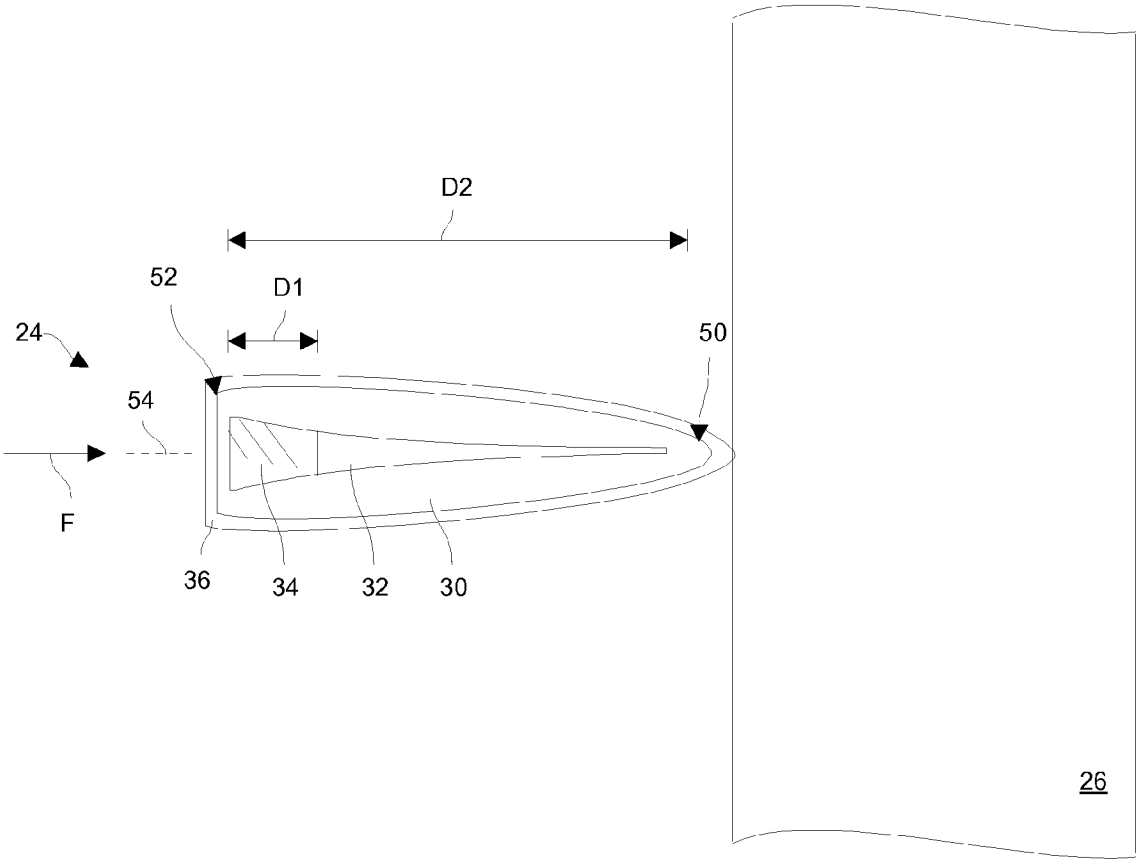
FIG. 2 is a cross-sectional diagram of an armor penetrating round prior to impacting a target.
Figure 3:
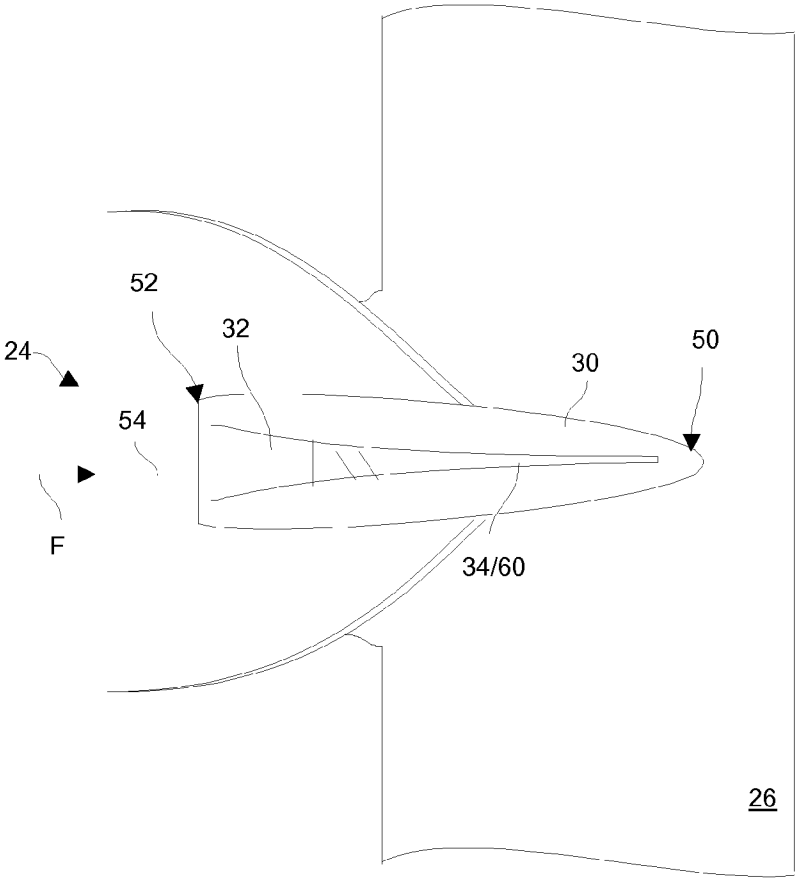
FIG. 3 is a cross-sectional diagram of the armor penetrating round after impacting the target.
Figure 4:
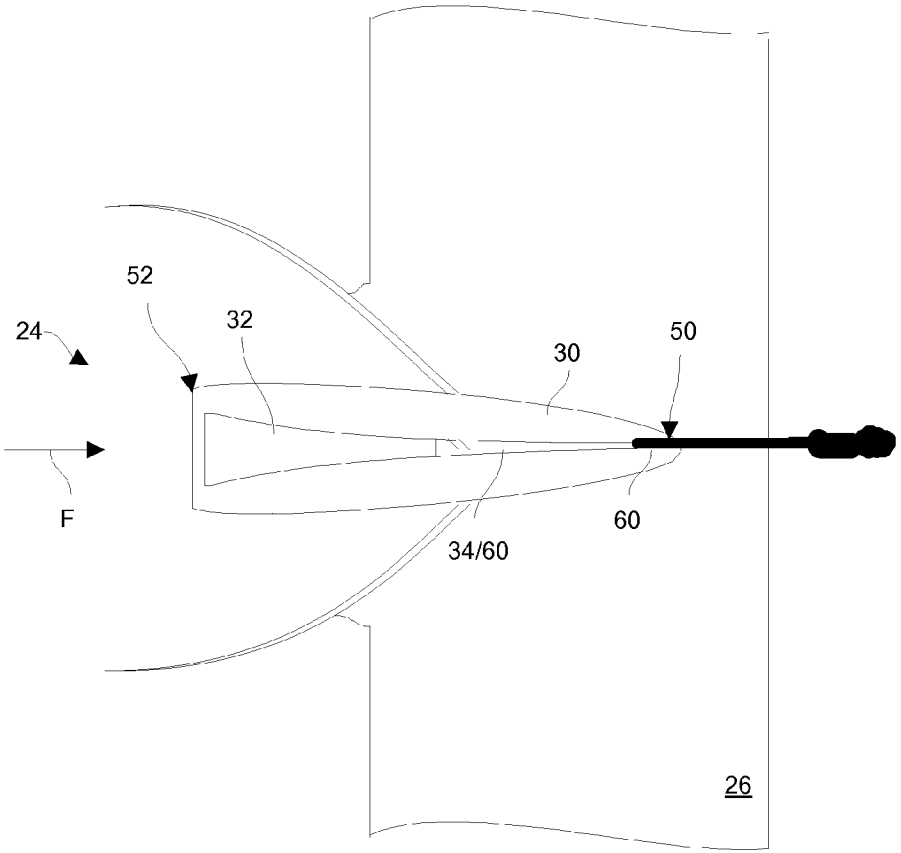
FIG. 4 is a cross-sectional diagram of the armor penetrating round after slug material forms a jet which penetrates through the target.

FIGS. 2-4 show the armor penetrating round 24 at various times during impact with the target 26. By way of example only, the target 26 in FIGS. 2-4 is a 1.5 inch thick RHA plate and the armor penetrating round 24 is a .50 caliber round having a muzzle velocity of 853 meters per second shot at the target 26 from 100 yards away. FIG. 2 shows a cross-section of the armor penetrating round 24 at the point of impact. FIG. 3 shows a cross-section of the armor penetrating round 24 after the core 30 has penetrated into the target 26, but prior to release of slug material from the core 30. FIG. 4 shows a cross-section of the armor penetrating round 24 when the slug material forms a jet which further penetrates into and ultimately through the target 26.

As illustrated in FIG. 2, the core 30 is elongated and defines a front end 50 (i.e., the leading part of the core 30 which hits the target 26 first), an aft end 52 (i.e., the trailing part of the core 30), and the cavity 32 which has a tapered shape. The cavity 32 extends along a central axis 54. As shown by the cross-section, an aft cross-sectional diameter of the cavity 32 adjacent the aft end 52 is larger than a front cross-sectional diameter of the cavity 32 adjacent the front end 50.

As further shown in FIG. 2, the slug 34 is disposed initially within the cavity 32 at the aft end 52. It should be understood that the slug 34 includes material which has a low yield strength and which is capable of forming a jet to perforate the front end 50 of the core 30 (FIGS. 3 and 4). To initially form the slug 34, the slug material may be pre-compacted and perhaps mixed with an epoxy or binder to hold the slug 34 together (FIG. 2). Examples of material which is suitable for forming the slug 34 include powdered metal such as lead powder, titanium powder, tantalum powder, and the like. In some arrangements, the slug 34 may further include a pyroforic material to enhance lethality.

It should be understood that the slug 34 does not fully fill the cavity 32 of the core 30. Rather, there is space in front of the slug 34 (e.g., air, inert gas, a vacuum, etc.) to enable material of the slug to move in the forward direction F during impact. In some arrangements, the slug 34 has a depth D1 as measured along the central axis 54 and the cavity 32 has a depth D2 as measured along the central axis 54, where D2 is in the range of 3 to 4 times D1. For example, in certain arrangements, the slug 34 is substantially 1 cm thick (i.e., D1=1 cm) and the cavity 32 is 3 to 4 cm's thick (i.e., D2=3 to 4 cm).

It should be further understood that the composition of the slug 34 and the tapered shape of the cavity 32 are such that, upon impact of the armor penetrating round 24 with the target 26, the slug 34 easily decouples from the aft end 52 of the core 30 and disintegrates due to shearing along the inner core walls within the cavity 32 as the slug material proceeds in the forward direction F through the cavity 32 as shown in FIG. 3 (i.e., the core walls become a de facto low friction boundary which pressurizes and accelerates the slug material as the slug material moves forward in accordance with Bernoulli's principle). That is, when the core 30 impacts the target 26, the core 30 immediately decelerates but the slug 34 retains much of the initial impact velocity. Accordingly, the slug material rushes in the forward direction R to form a jet (i.e., a stream having incompressible fluid properties due to the low yield strength of the material) which accelerates in the forward direction F to perforate a front tip of the core 30 (see FIG. 3) and further penetrate the target 26. With the slug material maintaining high kinetic energy, the slug material is capable of applying that energy to penetrate deeper into the target 26 and perhaps reach further target components.

In some arrangements, the geometry of the cavity 32 and the composition of the slug 34 are such that the material of the slug 34 is able to accelerate to at least 2 times (2×) that of the armor penetrating round 24 at initial impact velocity. For example, suppose that the impact velocity is 800 meters per second. In these arrangements, the slug material accelerates to a velocity of 1500 meters per second or higher. Other acceleration effects (e.g., 3×, etc.) are achievable by varying the geometries of the inner core walls and/or the composition of the slug 34.

As shown in FIG. 4, the accelerated slug material forms a jet 60 which perforates the front end 50 of the core 30 and is capable of further penetrating into and perhaps through the target 26 depending on target depth. For example, if the jet 60 is able to fully penetrate an outer target barrier as shown in FIG. 4, the escaping jet 60 is then able to reach and effect other target components in its path.

One should appreciate that several physical effects combine to provide the high performance aspects of the armor penetrating round 24. For example, the material of the slug 34 has very low yield strength. Additionally, the friction between the slug 34 and the inner walls of the core 30 does not significantly transfer a force between the core 30 and the slug 34. Rather, since the slug 34 is substantially made from pre-compacted metal powder, the material of the slug 34 shears along the contact surface resulting in a low friction boundary. This effect decouples the deceleration of the core 30 from the slug 34 during target penetration. As a result, the slug 34 retains much of its initial impact velocity while the core 30 decelerates. The slug 34 therefore maintains high kinetic energy which it applies to the target 26.

Because of the low yield stress of the slug material, the slug material behaves in a manner similar to that of an incompressible fluid as it travels down the central cavity 32 defined by the core 30. In particular, the slug material elongates and accelerates to a much higher velocity. Such operation results in very high pressure at the front end 50 causing perforation of the core 30 and hydrodynamic penetration of the target 26. Further details will now be provided with reference to FIG. 5.

Figure 5:
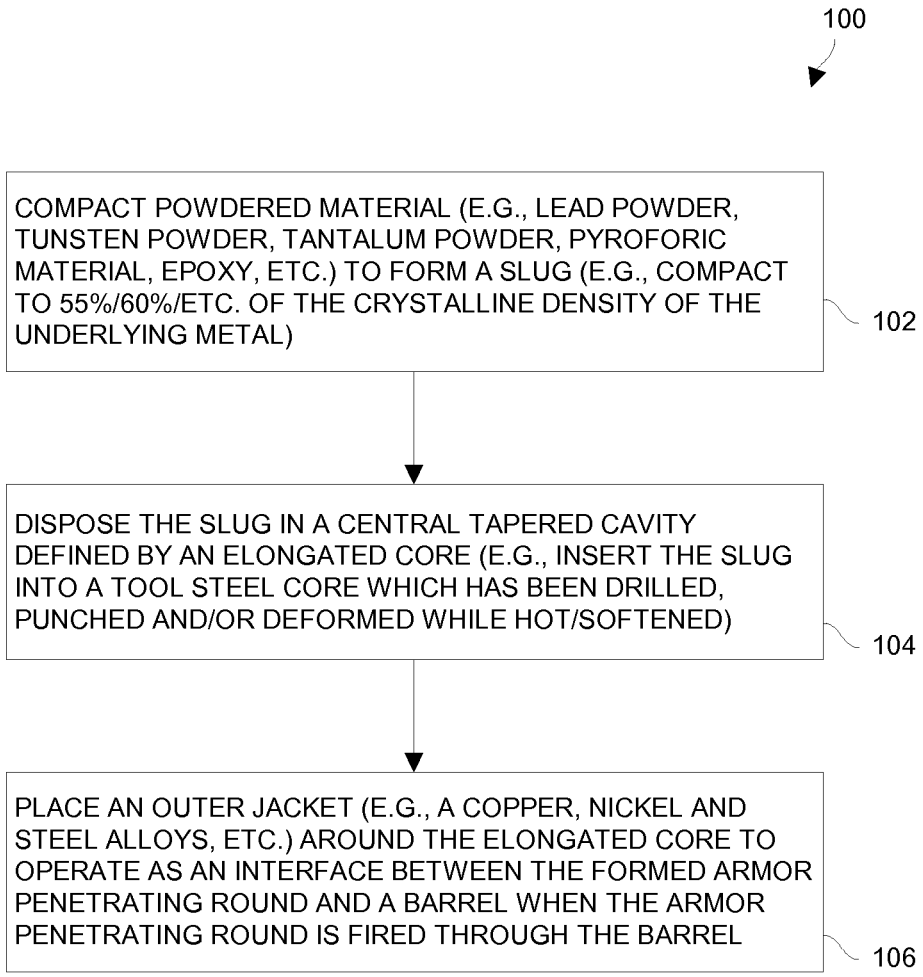
FIG. 5 is a flowchart of a procedure for making the armor penetrating round of FIG. 1.

FIG. 5 shows a flowchart of a procedure 100 for making a high performance armor penetrating round 24. In step 102, a manufacturer compacts powdered material to form a slug 34. In some arrangements, the powdered material includes powdered metal, pyroforic material, epoxy, combinations thereof, etc. Suitable powdered metals include lead powder, tungsten powder, tantalum powder, and similar powders which provide very low yield strength.

In step 104, the manufacturer disposes the slug 34 in a central tapered cavity 32 defined by an elongated core 30. The slug 34 occupies a volume which is smaller than a volume of the central cavity 32. In some arrangements, the elongated core 30 is substantially made of tool steel and the central tapered cavity 32 is formed while the tool steel remains hot/softened (e.g., drilled, punched, or otherwise deformed to provide the tapered shape). Once the core 30 has cooled and hardened, the slug 34 is inserted into the back end 52 of the core 30 (also see FIG. 2).

In step 106, the manufacturer places an outer jacket 36 around the elongated core 30 to operate as an interface between the formed armor penetrating round 24 and a barrel when the armor penetrating round 24 is later fired through the barrel. Suitable materials for the outer jacket 36 include copper, nickel and steel alloys, and the like.

It should be understood that such use of a high density powdered metal as the slug material results in effective jet 60 formation (also see FIG. 4). Such material is suitable since the material has essentially zero yield stress and does not significantly resist deformation and jetting. Moreover, the initially density of the powdered material within the slug 34 can be made fairly high by pre-compacting the powdered material yet keeping the effective strength low. In some arrangements, the slug material is pre-compacted over a relatively high percentage (e.g., 55%, 60%, etc.) of the crystalline density of the underlying metal (step 102). Accordingly, during the jet formation process, the high pressure near the throat (FIG. 4), the powdered metal achieves a density approaching the crystalline density of the underlying metal. As a result, the jet 60 essentially has the full density of the metal (e.g., tungsten, tantalum, etc.) thereby penetrating the target 26 very efficiently.

As mentioned above, an improved armor penetrating round 24 utilizes a hollow core 30 which contains a slug 34 to achieve penetration effects beyond that of a conventional armor piercing bullet. In particular, in the improved armor penetrating round 24, the slug 34 initially resides at the back of a tapered cavity 32 within the core 30. When the improved armor penetrating round 24 impacts an armored target 26 such as an armor plate, the material of the slug 34 decouples from the back of the tapered cavity 32 within the core 30 and accelerates through the tapered cavity 32 in the direction of the armor plate. As the material of the slug 34 shears against the tapered walls of the core 30 within the cavity 32, the slug material forms a jet 60 which provides further penetration into and perhaps through the armor plate. Accordingly, the armor penetrating round 24 is capable of providing enhanced destructive and/or lethal effects beyond conventional armor piercing bullets.

While various embodiments of the present disclosure have been particularly shown and described, it will be understood by those skilled in the art that various changes in form and details may be made therein without departing from the spirit and scope of the present disclosure as defined by the appended claims.

For example, it should be understood that the various geometries of the armor penetrating round 24 may be adjusted to achieve certain effects. Along these lines the dimension of the front end 50 of the core 30 may be changes (e.g., shortened, augmented with lead, etc.) to change the center of gravity or counter act the presence of the slug 34 and the cavity 32. Additionally, the geometries may be modified to increase core performance (i.e., core penetration into the target 26) over nozzle performance (i.e., jetting).

Additionally, it should be understood that, in some arrangements, the slug material is pre-compacted over a relatively high percentage of the crystalline density of the underlying metal such as 60%. It should be further understood that pre-compaction of less than 60% may be appropriate, e.g., for certain effects or in certain situations.

Furthermore, it should be understood that a variety of geometries are suitable for the front end of the cavity 32. For example, in some arrangements, the front end of the cavity 32 has a non-zero radius (see FIGS. 2-4). In these non-zero terminus arrangements, the front end of the cavity 32 may be narrow and almost cylindrical (e.g., produced by drilling a very small diameter hole into the hardened steel core). Such arrangements may facilitate manufacturability and provide satisfactory performance. However, in other arrangements, the front end of the cavity 32 is substantially conical, ending with essentially zero radius (a sharp point). Other suitable geometries include a rounded front end, a flattened front end, and so on. These different arrangements may be suitable in some situations to purposefully provide different performance results and/or to accommodate various manufacturing techniques. Such modifications and enhancements are intended to belong to various embodiments of this disclosure.

What is claimed is:

1. An armor penetrating round, comprising:

an elongated core portion defining a front end, an aft end, and a central cavity which extends from the aft end toward the front end, the central cavity having (i) an aft cross-sectional diameter adjacent the aft end and (ii) a front cross sectional diameter adjacent the front end, the aft cross sectional diameter being larger than the front cross sectional diameter;

a slug portion which is disposed within the central cavity adjacent the aft end; and an outer jacket which extends around the elongated core portion to operate as an interface between the armor penetrating round and a gun barrel when the armor penetrating round is fired through the gun barrel;

wherein the slug portion includes powder which is compressed to at least 60% of the crystalline density of the powder; and wherein the central cavity defined by the elongated core portion is configured to accelerate material of the slug portion, upon impact of the armor penetrating round with a target, to a velocity which is at least twice a velocity of the armor penetrating round prior to impact of the armor penetrating round with the target.

2. An armor penetrating round as in claim 1 wherein the central cavity defined by the elongated core portion tapers in a forward direction from the aft end toward the front end to accelerate the material of the slug portion, upon impact of the armor penetrating round with the target, in the forward direction due to a nozzle effect created by movement of the material through the central cavity in the forward direction.

3. An armor penetrating round as in claim 2 wherein the elongated core portion includes a front tip which (i) blocks the central cavity and (ii) is constructed and arranged to be penetrated by the material of the slug portion when the material of the slug portion is accelerated in the forward direction upon impact of the armor penetrating round with the target.

4. An armor penetrating round as in claim 3 wherein the slug portion includes powder which is pre-compacted into a high density body which is constructed and arranged to disintegrate upon impact of the armor penetrating round with the target.

5. An armor penetrating round as in claim 4 wherein the powder of the slug portion includes powdered metal.

6. An armor penetrating round as in claim 5 wherein the powdered metal of the slug portion substantially includes tungsten.

7. An armor penetrating round as in claim 5 wherein the powdered metal of the slug portion substantially includes tantalum.

8. An armor penetrating round as in claim 5 wherein the powdered metal of the slug portion substantially includes lead.

9. An armor penetrating round as in claim 5 wherein the powder of the slug portion further includes pyroforic material.

10. An armor penetrating round as in claim 3 wherein the central cavity defined by the elongated core portion is a substantially funnel-shaped volume;

wherein the slug portion occupies a slug volume which is smaller than the substantially funnel-shaped volume; and wherein the material of the slug portion forms a jet which flows through the substantially funnel-shaped volume and passes through the front tip of the elongated core portion upon impact of the armor penetrating round with the target.

11. Ammunition, comprising:

a shell;

a propellant loaded within the shell; and an armor penetrating round supported by the shell, the armor penetrating round including:

an elongated core portion defining a front end, an aft end, and a central cavity which extends from the aft end toward the front end, the central cavity having (i) an aft cross-sectional diameter adjacent the aft end and (ii) a front cross sectional diameter adjacent the front end, the aft cross sectional diameter being larger than the front cross sectional diameter, a slug portion which is disposed within the central cavity adjacent the aft end, the slug portion occupying a volume which is smaller than a volume of the central cavity, and an outer jacket which extends around the elongated core portion to operate as an interface between the armor penetrating round and a gun barrel when the propellant is ignited to fire the armor penetrating round through the gun barrel, wherein the slug portion includes powder which is compressed to at least 60% of the crystalline density of the powder, and wherein the central cavity defined by the elongated core portion is configured to accelerate material of the slug portion, upon impact of the armor penetrating round with a target, to a velocity which is at least twice a velocity of the armor penetrating round prior to impact of the armor penetrating round with the target.

12. Ammunition as in claim 11 wherein the central cavity defined by the elongated core portion of the armor penetrating round tapers in a forward direction from the aft end toward the front end to accelerate the material of the slug portion, upon impact of the armor penetrating round with the target, in the forward direction due to a nozzle effect created by movement of the material through the central cavity in the forward direction.

13. Ammunition as in claim 12 wherein the elongated core portion of the armor penetrating round includes a front tip which (i) blocks the central cavity and (ii) is constructed and arranged to be penetrated by the material of the slug portion of the armor penetrating round when the material of the slug portion of the armor penetrating round is accelerated in the forward direction upon impact of the armor penetrating round with the target.

14. Ammunition as in claim 13 wherein the slug portion of the armor penetrating round includes powder which is pre-compacted into a high density body which is constructed and arranged to disintegrate upon impact of the armor penetrating round with the target.

15. Ammunition as in claim 14 wherein the powder of the slug portion of the armor penetrating round includes powdered metal.

16. Ammunition as in claim 15 wherein the powdered metal of the slug portion substantially includes tungsten.

17. Ammunition as in claim 15 wherein the powdered metal of the slug portion substantially includes tantalum.

18. Ammunition as in claim 15 wherein the powder of the slug portion includes pyroforic material.

19. Ammunition as in claim 14 wherein the central cavity defined by the elongated core portion of the armor penetrating round is a substantially funnel-shaped volume;

wherein the slug portion of the armor penetrating round occupies a slug volume which is smaller than the substantially funnel-shaped volume; and wherein the material of the slug portion of the armor penetrating round forms a jet which flows through the substantially funnel-shaped volume and passes through the front tip of the elongated core portion of the armor penetrating round upon impact of the armor penetrating round with the target.

20. A method of creating an armor penetrating round, the method comprising:

compacting powdered material to form a slug portion;

disposing the slug portion in a central cavity defined by an elongated core portion, the slug portion occupying a volume which is smaller than a volume of the central cavity, the elongated core portion further defining a front end and an aft end, the central cavity extending from the aft end toward the front end, the central cavity having (i) an aft cross sectional diameter adjacent the aft end and (ii) a front cross sectional diameter adjacent the front end, the aft cross sectional diameter being larger than the front cross sectional diameter; and placing an outer jacket around the elongated core portion to operate as an interface between the armor penetrating round and a barrel when the armor penetrating round is fired through the barrel;

wherein the slug portion includes powder which is compressed to at least 60% of the crystalline density of the powder; and wherein the central cavity defined by the elongated core portion is configured to accelerate material of the slug portion, upon impact of the armor penetrating round with a target, to a velocity which is at least twice a velocity of the armor penetrating round prior to impact of the armor penetrating round with the target.

* * * * *